US009583079B2

(12) United States Patent
Suenaga et al.

(10) Patent No.: US 9,583,079 B2
(45) Date of Patent: Feb. 28, 2017

(54) SILENCER FOR WIND INSTRUMENT

(71) Applicant: Yamaha Corporation, Hamamatsu-Shi, Shizuoka-Ken (JP)

(72) Inventors: Yuichiro Suenaga, Hamamatsu (JP); Keizo Tatsumi, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 14/313,413

(22) Filed: Jun. 24, 2014

(65) Prior Publication Data

US 2014/0373698 A1 Dec. 25, 2014

(30) Foreign Application Priority Data

Jun. 24, 2013 (JP) ..... 2013-132118

(51) Int. Cl.
*G10D 9/06* (2006.01)

(52) U.S. Cl.
CPC ..... *G10D 9/06* (2013.01)

(58) Field of Classification Search
USPC ..... 84/400
See application file for complete search history.

(56) References Cited

U.S. PATENT DOCUMENTS

| | | | | |
|---|---|---|---|---|
| 1,448,232 | A * | 3/1923 | Navach | G10D 9/06 84/400 |
| 1,585,813 | A * | 5/1926 | Alimondo | G10D 9/06 84/400 |
| 1,776,216 | A | 9/1930 | Lewis | |
| 1,855,423 | A | 4/1932 | Sansone | |
| 2,252,847 | A | 8/1941 | Greenspan | |
| 2,439,733 | A | 4/1948 | Hermes | |
| 3,322,015 | A | 5/1967 | Berg | |
| 3,429,215 | A * | 2/1969 | Finch | G10D 9/06 84/400 |
| 3,842,706 | A | 10/1974 | Beversdorf | |
| 5,488,893 | A * | 2/1996 | Lewis | G10D 9/06 84/400 |
| 5,569,864 | A * | 10/1996 | Hamanaga et al. | 84/400 |
| 5,973,246 | A | 10/1999 | Hamanaga et al. | |
| 8,269,087 | B1 | 9/2012 | Davis | |
| 2013/0047818 | A1 | 2/2013 | Hamanaga | |

FOREIGN PATENT DOCUMENTS

| | | | |
|---|---|---|---|
| GB | 279667 | A | 11/1927 |
| JP | 54-33119 | | 3/1979 |
| JP | 9-299434 | A | 11/1997 |
| JP | 2865030 | B2 | 3/1999 |
| JP | 2001-240313 | A | 9/2001 |

(Continued)

OTHER PUBLICATIONS

European Search Report issued for coresponding application EP 14 17 3642, dated Aug. 7, 2014.

(Continued)

*Primary Examiner* — Christopher Uhlir
(74) *Attorney, Agent, or Firm* — Blank Rome LLP

(57) ABSTRACT

A silencer for a wind instrument includes a hollow pipe whose one end is closed and serves as a closed end. The pipe includes an outer wall having at least one of at least one recessed portion and at least one protruding portion on a portion of the outer wall near the closed end.

14 Claims, 5 Drawing Sheets

(56) References Cited

FOREIGN PATENT DOCUMENTS

| | | | |
|---|---|---|---|
| JP | 2001-282233 | A | 10/2001 |
| JP | 2004-199090 | A | 7/2004 |
| JP | 2008-096498 | A | 4/2008 |
| JP | 4114171 | B2 | 7/2008 |
| JP | 4986091 | B1 | 7/2012 |

OTHER PUBLICATIONS

Office Action from Chinese Patent Application No. 201410286324.6 dated Nov. 30, 2016 and English translation.

* cited by examiner

PRIOR ART

SILENCER FOR WIND INSTRUMENT

CROSS REFERENCE TO RELATED APPLICATION

The present application claims priority from Japanese Patent Application No. 2013-132118, which was filed on Jun. 24, 2013, the disclosure of which is herein incorporated by reference in its entirety.

BACKGROUND OF THE INVENTION

Field of the Invention

The present invention relates to a silencer for a wind instrument.

Description of the Related Art

Patent Document 1 (Japanese Patent No. 2865030) and Patent Document 2 (Japanese Patent No. 4986091) disclose silencers for wind instruments (hereinafter each referred to simply as "silencer") used for reducing a volume of sounds produced by a wind instrument such as a trumpet.

FIG. 11 is a side view (partially in cross section) illustrating a silencer disclosed in Patent Document 1. FIG. 11 illustrates a state in which the silencer is fitted in a wind instrument. As illustrated in FIG. 11, the silencer 23 is constituted by a front end portion 23A and a rear end portion 23B. The silencer 23 has an intermediate portion in its axial direction at which the front end portion 23A and the rear end portion 23B are bonded to each other. The silencer 23 has the largest outside diameter at the vicinity of this intermediate portion, and the outside diameter of the silencer 23 decreases toward a distal end 25 of the front end portion 23A and a distal end 26 of the rear end portion 23B. In a state in which a portion of the rear end portion 23B near the distal end 26 is secured to an inner wall of a bell 3 of the wind instrument, the front end portion 23A and a portion of the rear end portion 23B near a bonded portion of the silencer 23 at which the front end portion 23A and the rear end portion 23B are bonded to each other project outward or frontward from an end face of the bell 3. A user of this silencer 23 removes the silencer 23 from the wind instrument by grasping a side face of a portion of the silencer 23 near the bonded portion and/or a side face of the front end portion 23A and pulling the silencer 23 in a direction of an axis of the silencer 23, specifically, in a direction away from the bell 3 while rotating the silencer 23 about the axis by a small amount. This silencer 23 is easy to remove from the wind instrument but greatly projects outward from the end face of the bell 3. Thus, in a state in which the user holds the wind instrument in which the silencer 23 is fitted, the wind instrument is out of balance in most cases, specifically, the center of gravity of the wind instrument lies in front of the end face of the bell 3.

FIG. 12 is an elevational view in vertical cross section illustrating a silencer disclosed, in Patent Document 2. FIG. 12 illustrates a state in which the silencer is fitted in a wind instrument. As illustrated in FIG. 12, the silencer 10 is constituted by a body 1 and a bottom portion 2. The body 1 has generally a conical pipe shape, and its outside diameter decreases from a large-diameter end 1*b* toward a small-diameter end 1*a* along an inner wall of the bell 20. The bottom portion 2 is shaped like a bowl, and a bottom portion of the bowl is parallel to a plane perpendicular to the axis of the silencer 10. The bottom portion 2 smoothly curves from the bottom portion of the bowl toward an edge portion of the bowl, and the edge portion of the bowl is bonded to the body 1. In a state in which a portion of the body 1 near the small-diameter end 1*a* is secured to the inner wall of the bell 20, a portion of the silencer 10 near a bonded portion thereof at which the bottom portion 2 and the body 1 are bonded to each other is located at an end face of the bell 20, and the bottom portion 2 having the bowl shape projects outward of frontward from the end face of the bell 20. In this silencer 10, the bottom portion 2 projecting from the end face of the bell 20 is relatively short in length in the axial direction. Thus, in a state in which a user holds the wind instrument in which the silencer 10 is fitted, the center of gravity of the wind instrument does not lie in front of the end face of the bell 20 when compared with the wind instrument illustrated in FIG. 11.

SUMMARY OF THE INVENTION

However, the silencer 10 disclosed in Patent Document 2 is difficult to remove from the wind instrument. Specifically, since the bottom portion 2 projecting from the end face of the bell 20 is shaped like a bowl, and the length of the bottom portion 2 in the axial direction is relatively short, it is difficult for the user to grasp a side face of the bottom portion 2 and pull the silencer 10 in its axial direction, specifically, in a direction away from the bell 20 while rotating the silencer 10 about the axis by a small amount. Thus, the user removes the silencer 10 from the wind instrument by inserting his or her fingers and thumb into a space between the inner wall of the bell 20 and the silencer 10, grabbing the portion of the silencer 10 near the bonded portion with the fingers and thumb, and pulling the silencer 10 in the axial direction, specifically, in the direction away from the bell 20 while rotating the silencer 10 about the axis by a small amount. Even in this manner of removal, the silencer 10 is not easy to remove due to difficulty for the user in placing his or her fingers and thumb on the portion of the silencer 10 near the bonded portion.

This invention has been developed in view of the above-described situations, and it is an object of the present invention to provide a technique for easily removing a silencer from a wind instrument, in particular, a technique for easily removing, from a wind instrument, a silencer having a relatively short portion projecting from an end face of a bell in a sate in which the silencer is fitted in the wind instrument.

The object indicated above may be achieved according to the present invention which provides a silencer for a wind instrument, including a hollow pipe whose one end is closed and serves as a closed end, the pipe including an outer wall having at least one recessed portion or at least one protruding portion on a portion of the outer wall in a vicinity of the closed end.

The object indicated above may be achieved according to the present invention which also provides a silencer for a wind instrument, including a hollow pipe whose one end is closed and serves as a closed end, the pipe including an outer wall having at least one inequality on a portion thereof in a vicinity of the closed end.

According to the inventions described above, the user can place his or her finger onto a projected or recessed portion of the outer wall near the closed end of the hollow pipe, i.e., onto a portion of the pipe whose length from an axis of the pipe to the outer wall is relatively short (i.e., a recessed portion), allowing the user to easily remove, from the wind instrument, the silencer fitted in an inner wall of a bell of the wind instrument.

It is noted that Patent Document 3 (U.S. Pat. No. 3,322,015) discloses a silencer provided with a ring into which a finger is to be inserted and which is provided on an outer wall of a central portion of a bottom portion projecting from an end face of a bell. The silencer disclosed in Patent Document 3 allows the user to remove the silencer from the wind instrument by inserting his or her index finger into the ring and holding the silencer. In the silencer according to the present invention, in contrast, at least one recessed portion or at least one protruding portion for placement of a finger is provided on the portion of the outer wall near the closed end (i.e., near the bottom portion) of the pipe (i.e., the body) to facilitate removing the silencer from the wind instrument. Accordingly, the silencer according to the present invention is totally different from the silencer disclosed in Patent Document 3. Since not only the bottom portion but also the ring projects from the end face of the bell in the silencer disclosed in Patent Document 3, it is difficult to reduce the size of the silencer. In the silencer according to the present invention, however, a projecting portion like the ring disclosed in Patent Document 3 is not provided outside the end face of the bell, making it possible to reduce the size of the silencer.

BRIEF DESCRIPTION OF THE DRAWINGS

The objects, features, advantages, and technical and industrial significance of the present invention will be better understood by reading the following detailed description of the embodiments of the invention, when considered in connection with the accompanying drawings, in which.

DETAILED DESCRIPTION OF THE EMBODIMENTS

Hereinafter, there will be described embodiments of the present invention by reference to the drawings.

First Embodiment

Figure 1A:
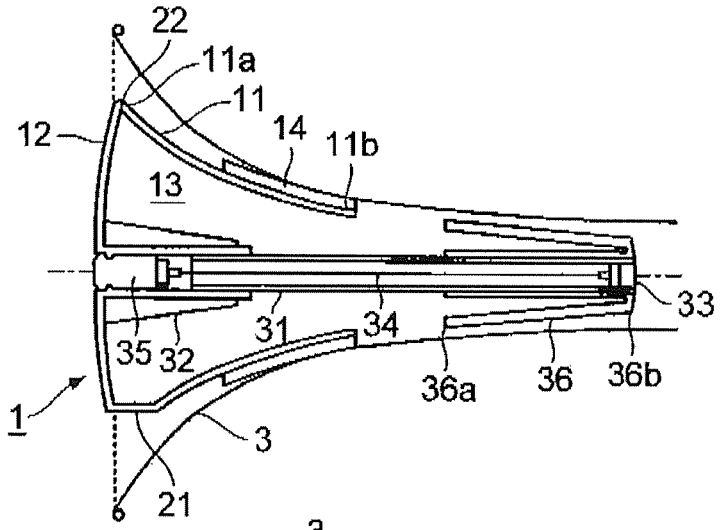
FIGS. 1A-1C are an elevational view in vertical cross section, a front elevational view, and a perspective view illustrating a construction of a silencer 1 according to one embodiment of the present invention.
Figure 1B:
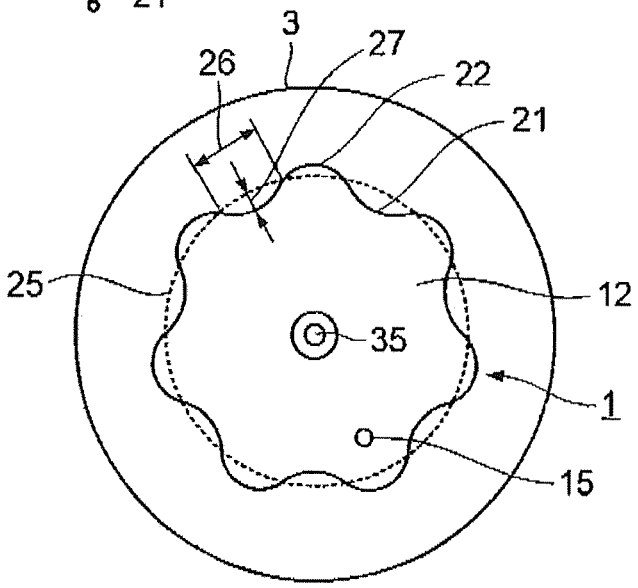
Figure 1C:
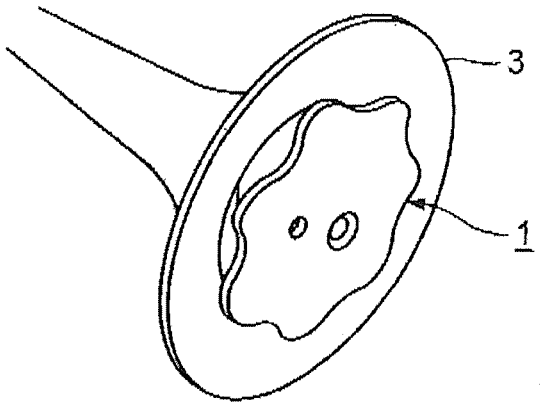

FIGS. 1A-1C illustrate a silencer 1 according to a first embodiment of the invention. This silencer 1 according to the present embodiment is a silencer for a trumpet, FIGS. 1A-1C illustrate a state in which the silencer 1 is fitted in the trumpet. As illustrated in FIG. 1, the silencer 1 generally is a conical pipe having a bottom and constituted by a body 11 and a bottom portion 12. Each of the body 11 and the bottom portion 12 is formed of plastic, for example. In the present embodiment, the silencer 1 is configured such that a portion of an outer wall of the body 11 near the bottom portion 12 has a wavy circular shape around an axis of the body 11, that is, inequalities or undulations, i.e., recessed portions 21 and protruding portions 22 are provided in and on the portion of the outer wall of the body 11 in order to facilitate removing the silencer 1 from the trumpet.

The body 11 is formed like a hollow conical pipe so as to have a cavity 13. This body 11 has a large-diameter end 11*a* as its front end and a small-diameter end as its rear end. Each of the outside diameter and the inside diameter decreases from the large-diameter end 11*a* toward the small-diameter end 11*b* along an inner wall of a bell 3 of the trumpet, and an opening is formed in the small-diameter end 11*b*. Near the small-diameter end 11*b*, a flexible mount portion 14 is provided on an outer surface of the body 11. This mount portion 14 helps a portion of the body 11 near the small-diameter end 11*b* to be secured to the inner wall of the bell 3 of the trumpet.

The bottom portion 12 is shaped like a pan, and a bottom portion of the pan is located near an axis of the silencer 1. An edge portion of the pan as the bottom portion 12 is bonded to the large-diameter end 11*a* of the body 11 by, e.g., adhesives. The bottom portion 12 serves as a closing portion which closes the large-diameter end 11*a* as the front end of the body 11, and accordingly the large-diameter end 11*a* is a closed end. The bottom portion 12 is located near an end face of the bell 3 when the body 11 is secured to the inner wall of the bell 3 of the trumpet. More specifically, a portion of the silencer 1 near the portion of the bottom portion 12 which is bonded to the body 11 is located near the end face of the bell 3, and the bottom portion 12 projects outward or frontward from the end face of the bell 3 by an amount corresponding to a curve of the bottom portion 12.

In the silencer 1 according to the present embodiment, the undulations and inequalities are provided on the portion of the outer wall of the body 11 near the bottom portion 12 (i.e., near the large-diameter end 11*a* as the closed end). That is, the portion of the outer wall of the body 11 near the bottom portion 12 includes: the recessed portions 21 bent or recessed in a direction toward the axis of the body 11; and the protruding portions 22 bent or protruding in a direction away from the axis of the body 11, and the recessed portions 21 and the protruding portions 22 alternately arranged so as to be uniformly spaced apart from each other around the axis of the body 11. Here, the wordings "near the bottom portion 12" or "near the closed end" means an area corresponding generally to a distance from the large-diameter end 11*a* as the closed end to a finger tip in the axial direction of the body 11 when fingers are inserted from a front side of the bottom portion 12 into a position between an outer wall of the silencer 1 mounted on the wind instrument (i.e., the outer wall of the body 11) and the inner wall of the bell 3. The recessed portions 21 arranged around the axis of the body 11 have the same distance between the axis of the body 11 and a bottom of each recessed portion 21. The large-diameter end 11*a* of the body 11 is continuous to an edge of the bottom portion 12 while keeping the shape of the recessed portions 21 and the protruding portions 22 on the large-diameter end 11*a*. As illustrated in FIG. 1B, when the bottom portion 12 is viewed from a front side thereof along the axis of the body 11, the edge of the bottom portion (i.e., the portion of the silencer 1 near the portion of the bottom portion 12 which is bonded to the body 11) has a smooth wavy circular shape around the axis of the body 11. Each of the recessed portions 21 has a dimension or size suitable for a user to place his or her finger on the recessed, portion 21. For example, a width 26 of the recessed portion 21 (i.e., a length from an inflection point at which the shape of the edge of the bottom portion changes from the protruding portion 22 to the recessed portion 21 to an inflection point at which the shape of the edge of the bottom portion changes from the recessed portion 21 to the protruding portion 22) is about 15 mm, and a depth 27 of the recessed portion 21 (i.e., a length obtained by subtracting a distance from the axis of the body 11 to the bottom of the recessed portion 21, from a distance from the axis of the body 11 to a circle 25 indicated by a broken line and formed by connecting the inflection points of the protruding portions 22 and the recessed portions 21) is about 5 mm. It is noted that the plurality of recessed portions 21 have the same dimension in the present embodiment but may have different dimensions. For example, the recessed portions 21 may be formed such that the recessed portion 21 for the thumb has a relatively large dimension, and the recessed portion 21 for the little finger has a relatively small dimension.

In the silencer 1 according to the present embodiment, the seven recessed portions 21 and the seven protruding portions 22 are provided around the axis of the body 11. The number of the recessed portions 21 and the number of the protruding portions 22 are determined based on the diameter of the bottom portion 12. More specifically, since the silencer 1 according to the present embodiment is for trumpets, the diameter of the bottom portion 12 (i.e., the diameter of the circle 25 centered about the axis of the body 11 and formed by connecting the inflection points of the protruding portions 22 and the recessed portions 21) is about 70 mm. In a case where the recessed portions 21 each having the dimension appropriate for the user to place his or her finger on the edge of the bottom portion 12 having this diameter are arranged so as to be spaced uniformly, the appropriate number of the recessed portions 21 is seven.

Figure 2:
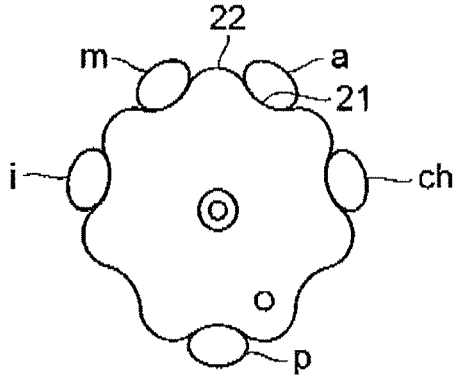
FIG. 2 is a front elevational view for explaining a relationship between positions of recessed portions 21 of the silencer 1 and positions of fingers placed on the recessed portions 21.

In this silencer 1, as illustrated in FIG. 2, the recessed portions 21 are arranged symmetrically with respect to a line obtained by extending a line connecting each recessed portion 21 and the axis of the body 11. In this silencer 1 as described above, the odd number of the recessed portions 21 and the odd number of the protruding portions 22 (in the present embodiment, the seven recessed portions 21 and the seven protruding portions 22) are arranged around the axis of the body 11 so as to be spaced uniformly. Furthermore, in the cross section perpendicular to the axis of the body 11, each of the protruding portions 22 is disposed at a position of intersection of the outer wall of the body 11 and a line obtained by extending a line connecting the position of a corresponding one of the recessed portions 21 and the axis of the body 11, and in the cross section perpendicular to the axis of the body 11, each of the recessed portions 21 is disposed at a position of intersection of the outer wall of the body 11 and a line obtained by extending a line connecting the position of a corresponding one of the protruding portions 22 and the axis of the body 11. In other words, each of the recessed portions 21 is disposed at a position symmetrical with a corresponding one of the protruding portions 22 with respect to a point on the axis of the body 11. In a case where the thumb and fingers are placed on the recessed portions 21, as illustrated in FIG. 2, it is considered that the middle finger m and the ring finger a are respectively placed on the recessed portions 21 located adjacent to and on opposite sides of the protruding portion 22 disposed at the position of intersection of the outer wall of the body 11 and the line obtained by extending the line connecting the axis of the body 11 and the recessed portion 21 on which the thumb p is placed. It is further considered that the index finger i is placed on the recessed portion 21 that is adjacent to the recessed portion 21 on which the middle finger m is placed and that is located on an opposite side of the recessed portion 21 on which the middle finger in is placed from the recessed portion 21 on which the ring finger a is placed, and the little finger ch is placed on the recessed portion 21 that is adjacent to the recessed portion 21 on which the ring finger a is placed and that is located on an opposite side of the recessed portion 21 on which the ring finger a is placed from the recessed portion 21 on which the middle finger m is placed. That is, the index finger i and the little finger ch are symmetrical with respect to the line obtained by extending the line connecting the axis of the body 11 and the recessed portion 21 on which the thumb p is placed, while the middle finger in and the ring finger a are symmetrical with respect to the line obtained by extending the line connecting the axis of the body 11 and the recessed portion 21 on which the thumb p is placed, and furthermore the index finger i, the middle finger m, the ring finger a, and the little finger ch are located on an opposite side of a boundary line from the thumb p, which boundary line is a line extending through the axis of the body 11 and perpendicular to the line connecting the axis of the body 11 and the recessed portion 21 on which the thumb p is placed. This construction allows the user to grab the silencer 1 in a natural manner and apply forces to the fingers and thumb uniformly.

The bottom portion 12 is formed with a through hole 15 having the diameter equal to or larger than the minimum inside diameter of a mouthpiece of the trumpet. A breath blown by the user from the mouthpiece of the trumpet passes through the interior of the trumpet, is delivered into the cavity 13 of the silencer 1 from the small-diameter end 11*b* of the body 11, and is discharged from the through hole 15 of the bottom portion 12 to an outside space of the silencer 1.

A supporter 32 is provided in the silencer 1 near the center of the bottom portion 12. This supporter is for supporting a signal line protecting pipe 31 disposed along the axis of the body 11 in a direction directed from the bottom portion 12 to the small-diameter end 11*b* of the body 11. A microphone 33 is attached to a distal end of the signal line protecting pipe 31, and a signal line 34 connected to the microphone 33 extends in the signal line protecting pipe 31. This signal line 34 is connected to a signal output portion 35 such as an earphone jack provided at the center of the bottom portion 12. An auxiliary body 36 is fixed near the distal end of the signal line protecting pipe 31 to which the microphone 33 is attached. The outside diameter and the inside diameter of the auxiliary body 36 decrease along the inner wall of the bell 3 toward the distal end of the signal line protecting pipe 31 to which the microphone 33 is attached. The auxiliary body 36 has an open large-diameter end 36*a* and a small-diameter end 36*b* which is closed at the distal end of the signal line protecting pipe 31.

Figure 3:
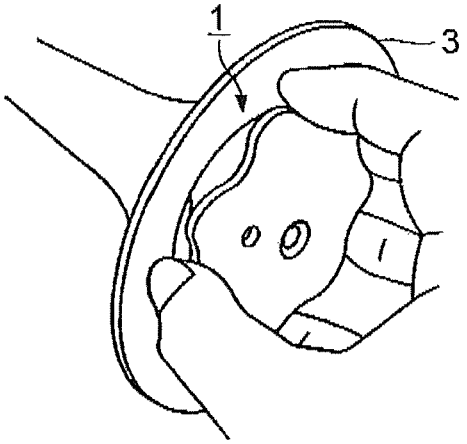
FIG. 3 is a perspective view for explaining a removal of the silencer 1 from a trumpet.

There will be next explained, with reference to FIG. 3, operations for removing the silencer 1 according to the present embodiment from the trumpet. Since the recessed portions 21 and the protruding portions 22 are provided in and on the outer wall of the body 11 near the bottom portion 12 of the silencer 1, a space is narrow and small between the protruding portions 22 of the silencer 1 and the inner wall of the bell 3 of the trumpet in which the silencer 1 is fitted, and the space between the recessed portions 21 of the silencer 1 and the inner wall of the bell 3 is wide and large. Thus, the user inserts his or her fingers and thumb into the space between the recessed portions 21 of the silencer 1 and the inner wall of the bell 3 from a front side of the bell 3 in which the silencer 1 is fitted, to place the fingers and thumb onto the recessed portions 21. In this operation, the fingers and thumb are placed on the recessed portions 21 described above with reference to FIG. 2. The user then firmly grabs the silencer 1 with the four fingers and thumb placed on the recessed portions 21 and pulls the silencer 1 in the axial direction and in a direction away from the bell 3 while rotating the silencer 1 about the axis by a small amount. As a result, the silencer 1 is removed from the trumpet.

In the silencer 1 according to the present embodiment as described above, the inequalities are provided around the axis of the body 11 on the portion of the outer wall the body 11 near the bottom portion 12 near the large-diameter end 11*a* as the closed end), that is, the portion of the outer wall the body 11 includes the recessed portions 21 and the protruding portions 22. This construction forms a wider space between the recessed portions 21 of the silencer 1 and the inner wall of the bell 3, allowing the user to place the fingers and thumb on the recessed portions 21 and firmly grab the silencer 1. Also, when rotating the grabbed silencer 1 about the axis by a small amount, the fingers and thumb are caught by the silencer 1 between the recessed portions 21 and the protruding portions 22, allowing the user to easily rotate the silencer 1 about the axis of the body 11. Accordingly, the user can easily remove the silencer 1 from the trumpet. Also, the seven (odd-number) recessed portions 21 and the seven (odd-number) protruding portions 22 are arranged around the axis of the body 11 so as to be spaced uniformly, making it possible to grab the silencer 1 in a natural manner and apply forces to the fingers and thumb uniformly. Also, the number of the recessed portions 21 arranged around the axis of the body 11 is relatively large, allowing the user to place the fingers and thumb on the recessed portions 21 without a need to check the positions of the recessed portions 21.

Second Embodiment

Figure 4:
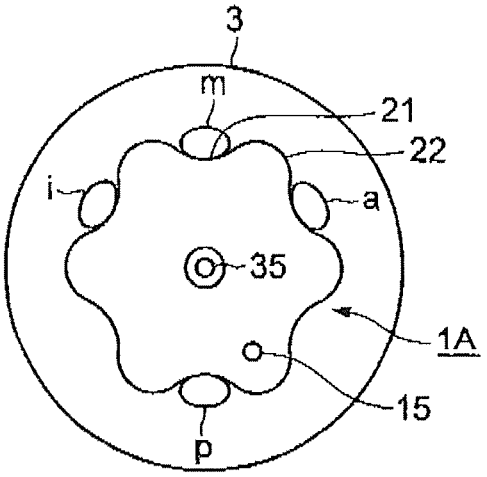
FIG. 4 is a front elevational view illustrating a construction of a silencer 1A according to a second embodiment of the invention.

FIG. 4 illustrates a silencer 1A according to a second embodiment of the invention. The silencer 1A according to the present embodiment is similar to the silencer 1 according to the first embodiment in construction in which the silencer 1A includes, at the portion of the outer wall of the body 11 near the bottom portion 12, the recessed portions 21 bent in the direction toward the axis of the body 11 and the protruding portions 22 bent in the direction away from the axis of the body 11, and the recessed portions 21 and the protruding portions 22 alternately arranged around the axis of the body 11 so as to be spaced uniformly. However, the silencer 1A according to the present embodiment differs from the silencer 1 according to the first embodiment in the number and arrangement of the recessed portions 21 and the protruding portions 22 around the axis of the body 11.

As illustrated in FIG. 4, the six recessed portions 21 and the six protruding portions 22 are arranged around the axis of the body 11 in the silencer 1A. Thus, in the cross section perpendicular to the axis of the body 11, each of the recessed portions 21 is disposed at a position of intersection of the outer wall of the body 11 and a line obtained by extending a line connecting a position of a corresponding one of the recessed portions 21 and the axis of the body 11, and in the cross section each of the protruding portions 22 is disposed at a position of intersection of the outer wall of the body 11 and a line obtained by extending a line connecting a position of a corresponding one of the protruding portions 22 and the axis of the body 11. That is, each pair of the recessed portions 21 are disposed such that an angle of a line connecting one of the pair of the recessed portions 21 and the axis of the body 11 and a line connecting the other of the pair of the recessed portions 21 and the axis of the body 11 is 180 degrees. In the construction in which the recessed portions 21 are provided in this manner, as illustrated in FIG. 4, it is considered that the middle finger m is placed on the recessed portion 21 disposed at a position of intersection of the outer wall of the body 11 and a line obtained by extending a line connecting the axis of the body 11 and the recessed portion 21 on which the thumb p is placed, and the index finger i and the ring finger a are respectively placed on the recessed portions 21 located adjacent to and on opposite sides of the recessed portion 21 on which the middle finger m is placed. That is, an angle of a line connecting the thumb p and the axis of the body 11 and a line connecting the middle finger m and the axis of the body 11 is 180 degrees, and the index finger i and the ring finger a are symmetrical with respect to a line obtained by extending the line connecting the axis of the body 11 and the recessed portion 21 on which the thumb p is placed, and furthermore, the index finger i, the middle finger in, and the ring finger a are located on an opposite side of a boundary line from the thumb p, which boundary line is a line extending through the axis of the body 11 and perpendicular to the line connecting the axis of the body 11 and the recessed portion 21 on which the thumb p is placed. This construction allows the user to grab the silencer 1A in a natural manner and uniformly apply forces to the fingers and thumb placed on the recessed portions 21. Therefore, the silencer 1A according to the present embodiment can achieve the same effects as achieved in the first embodiment.

In FIG. 4, the six recessed portions 21 and the six protruding portions 22 are alternately arranged around the axis of the body 11 so as to be spaced uniformly, but the recessed portions 21 and the protruding portions 22 may not be alternately arranged so as to be spaced uniformly, and the number of the recessed portions 21 is not limited to six, as long as at least two recessed portions 21 of the plurality of recessed portions 21 are arranged such that an angle of a line connecting one of the two recessed portions 21 and the axis of the body 11 and a line connecting the other of the two recessed portions 21 and the axis of the body 11 is 180 degrees. This is because the silencer 1A can be easily removed from the trumpet in the case where the thumb p is placed on one of the two recessed portions 21 arranged such that the angle of the lines connecting the axis of the body 11 and the respective two recessed portions 21 is 180 degrees, and another finger (e.g., the middle finger in) is placed on the other recessed portions 21.

Other Embodiments

While the embodiments of the present invention have been described above, it is to be understood that the invention is not limited to the details of the illustrated embodiments, but may be embodied with various changes and modifications, which may occur to those skilled in the art, without departing from the spirit and scope of the invention.

Figure 5:
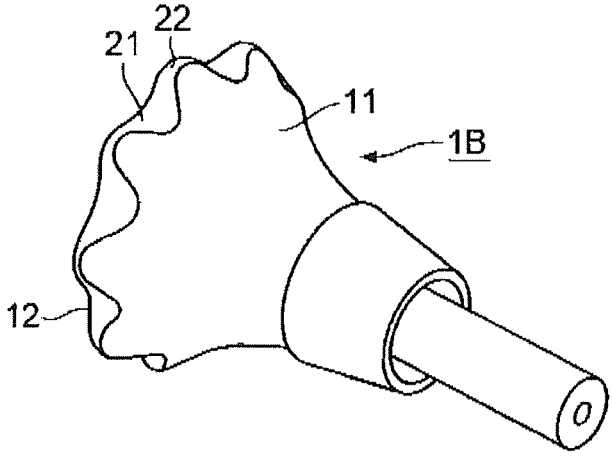
FIG. 5 is a perspective view illustrating one example of a silencer 1B for a trombone as an alternative embodiment (1)
Figure 6:
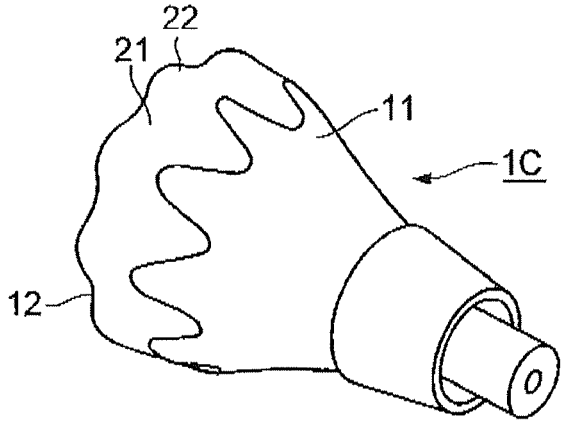
FIG. 6 is a perspective view illustrating one example of a silencer 1C for a French horn as the alternative embodiment (1)
Figure 7:
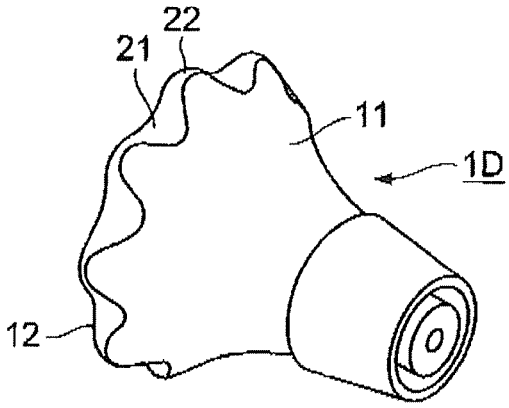
FIG. 7 is a perspective view illustrating one example of a silencer 1D for a flugelhorn as the alternative embodiment (1)
Figure 8:
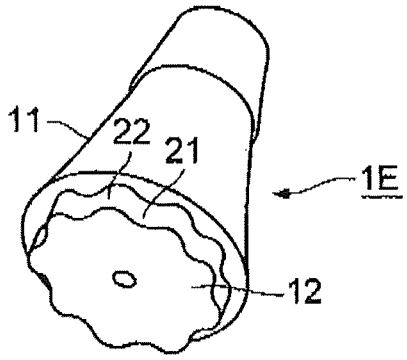
FIG. 8 is a perspective view illustrating one example of a silencer 1E for a wind instrument having a large-dimension bell as the alternative embodiment (1)

(1) While the silencers 1, 1A according to the above-described embodiments are for trumpets, the present invention is applicable to silencers for wind instruments other than the trumpets, FIGS. 5-7 respectively illustrate a silencer 1B for trombones, a silencer 1C for French horns, and a silencer 1D for flugelhorns. As illustrated in FIGS. 5-7, each of the silencers 1B-1D has a conical shape corresponding to a corresponding one of the bells 3 of the wind instruments and is configured such that the recessed portions 21 and the protruding portions 22 are arranged around the axis of the body 11 on the outer wall near the bottom portion 12. The diameters of the respective bottom portions 12 of the silencers 1B-1D (i.e., the diameter of the circle formed by connecting the inflection points of the protruding portions 22 and the recessed portions 21) differ according to the shapes of the bells 3 of the wind instruments, and accordingly the number of the recessed portions 21 arranged around the axis of the body 11 differs according to the wind instruments to which the silencers 1B-1D are respectively fitted. For example, since the diameter of the bottom portion 12 is about 110 mm in the silencer 1B for trombones, the nine recessed portions 21 are preferably provided. In a silencer used for a wind instrument including the large-diameter bell 3 such as a tuba, the bottom portion 12 of the silencer has a relatively large diameter, and accordingly the user may have difficulty of grabbing the portion of the silencer near the bottom portion 12 from a front side thereof with his or her fingers. This problem is addressed by a silencer 1E illustrated in FIG. 8. In this silencer 1E, a portion of the body 11 near the bottom portion 12 on which the recessed portions 21 and the protruding portions 22 are provided has a relatively small diameter, and the other portion of the body 11 has a relatively large diameter for adaptation for the shape of the bell 3. As a result, the fingers can be placed on the recessed portions 21 formed in the small-diameter portion of the body 11 near the bottom portion 12, allowing the user to easily grab the silencer 1E.

(2) While the recessed portions 21 and the protruding portions 22 are alternately and repeatedly arranged around the axis of the body 11 so as to be spaced uniformly in the above-described embodiments, the recessed portions 21 and the protruding portions 22 may not be spaced uniformly and may not be arranged alternately and repeatedly. That is, at least one of at least one protruding portion and at least one recessed portion (an undulation or an inequality) only needs to be formed on the outer wall of the body 11 at least near the bottom portion 12. This is because at least one recessed portion 21 allows the user to place his or her finger on the recessed portion 21 and easily remove the silencer from the wind instrument. This recessed portion 21 is preferably provided in the silencer such that the capacity of the cavity formed in the silencer is determined so as not to affect intonations produced by the wind instrument to which the silencer is fitted. While the seven recessed portions 21 and the six recessed portions 21 are respectively formed in the silencer 1 according to the first embodiment and the silencer 1A according to the second embodiment, the number of the recessed portions 21 is not limited to these. For example, the silencer may not include the recessed portions 21 on which the fingers and thumb are not placed in the silencer 1 illustrated in FIG. 2.

(3) In the first embodiment, the recessed portions 21 and the protruding portions 22 are alternately provided around the axis of the body 11 so as to be spaced uniformly, and the number of the recessed portions 21 arranged around the axis of the body 11 is seven, whereby each of the protruding portions 22 is disposed at the position of intersection of the outer wall of the body 11 and the line obtained by extending the line connecting the corresponding recessed portion 21 and the axis of the body 11. However, the silencer may be configured such that the recessed portions 21 and the protruding portions 22 are alternately provided around the axis of the body 11, and the number of the recessed portions 21 arranged around the axis of the body 11 is made an odd number other than seven. Also in this configuration, each of the protruding portions 22 is disposed at the position of intersection of the outer wall of the body 11 and the line obtained by extending the line connecting the corresponding recessed portion 21 and the axis of the body 11, allowing the user to uniformly apply forces to his or her fingers and thumb used for grabbing the silencer.

(4) In the above-described embodiments, when each of the silencers 1, 1A is fitted in the trumpet, the portion of the silencer near the portion of the bottom portion 12 which is bonded to the body 11 is located near the end face of the bell 3, and the bottom portion 12 projects slightly from the end face of the bell 3. When the silencer is fitted in the trumpet, however, the bottom portion of the silencer may be positioned in a space surround with the inner wall of the bell 3. Even when the entire silencer is located inside the end face of the bell 3, the user can place his or her finger on the recessed portions provided on the silencer to easily remove the silencer. When the silencer is fitted in the trumpet, the bottom portion of the silencer may of course greatly projects from the end face of the bell 3. This embodiment also allows the user to place his or her fingers on the recessed portions to easily remove the silencer.

(5) In the silencers 1, 1A according to the above-described embodiments, the recessed portions 21 and the protruding portions 22 are repeatedly provided in the smooth wavy shape around the axis of the body 11. However, the recessed portions 21 and the protruding portions 22 may be repeatedly provided in an angular wavy shape around the axis of the body 11. That is, the edge of the bottom portion 12 may have a polygonal shape when the bottom portion 12 is viewed from a front side thereof in the direction of the axis of the body 11.

(6) In each of the silencers 1, 1A according to the above-described embodiments, each recessed portion 21 has a dimension suitable for the placement of one finger. However, each recessed portion 21 may have a dimension suitable for a plurality of fingers to be placed.

(7) A portion of the outer wall of the bottom portion 12 near the body 11 may be partly or entirely recessed in a direction directed from the large-diameter end 11*a* toward the small-diameter end 11*b*. Also in this embodiment, the portion of the outer wall of the body 11 near the bottom portion 12 has at least one of at least one protruding portion and at least one recessed portion, FIGS. 9A-9D illustrate silencers 1F-1I as alternative embodiments. In the silencer 1F illustrated in FIG. 9A, the portion of the outer wall of the bottom portion 12 near the body 11 is partly recessed in the direction directed from the large-diameter end 11*a* to the small-diameter end 11*b*, whereby the shape of the outer wall of the body 11 when the body 11 is cut along the plane perpendicular to the axis of the body 11 is changed from a circle to a triangle, at a boundary between the portion of the outer wall near the bottom portion 12 and a portion of the outer wall not near the bottom portion 12, in a direction directed from the small-diameter end 11*b* toward the large-diameter end 11*a*. Edge lines extending in the axial direction of the body 11 from the vertexes of the triangle formed by the portion of the outer wall of the body 11 near the bottom portion 12 are continuous to the outer wall of the circle formed by the portion of the outer wall of the body 11 not near the bottom portion 12. In this silencer 1F, when the silencer 1F is fitted in the wind instrument, a space defined between the inner wall of the bell 3 and sides of the triangle of the outer wall of the body 11 is larger than a space defined between the inner wall of the bell 3 and vertex portions of the triangle of the outer wall of the body 11. That is, planar faces extending in the axial direction of the body 11 from the respective sides of the triangle formed by the portion of the outer wall of the body 11 near the bottom portion 12 serve as the recessed portions 21. This construction allows the user to place his or her fingers, from a front side of the bottom portion 12, onto the planar faces extending in the axial direction of the body 11 from the respective sides of the triangle formed by the portion of the outer wall of the body 11 near the bottom portion 12. Also, a rotational direction in which the silencer 1F is rotated by a small amount about the axis of the body 11 is not parallel to each planar face on which the finger is to be placed. This construction makes it difficult for the fingers to slip in the rotational direction, allowing the silencer 1F to be easily rotated about the axis of the body 11. Thus, the silencer 1F also allows the user to easily remove the silencer 1F from the wind instrument.

Figure 9A:
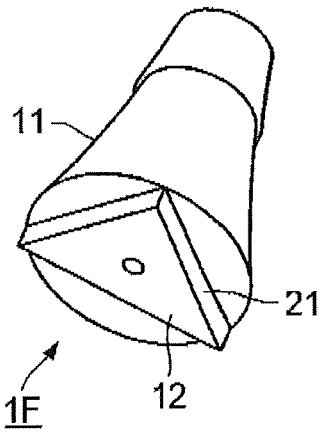
FIGS. 9A-9D are perspective views illustrating constructions of silencers 1F-1I each as an alternative embodiment (7)
Figure 9B:
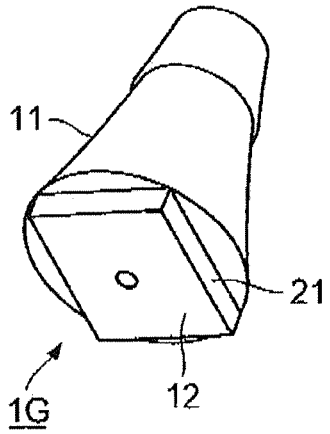

A silencer 1G illustrated in FIG. 9B differs from the silencer 1F illustrated in FIG. 9A in that the portion of the outer wall of the body 11 near the bottom portion 12 has a quadrangle shape instead of the triangle shape. In this silencer 1G, planar faces extending in the axial direction of the body 11 respectively from sides of the quadrangle formed by the portion of the outer wall of the body 11 near the bottom portion 12 serve as the recessed portions 21. Accordingly, the silencer 1G can achieve the same effects as achieved by the silencer 1F. It is noted that the shape of the portion of the outer wall of the body 11 near the bottom portion 12 is not limited to the triangle illustrated in FIG. 9A and the quadrangle illustrated in FIG. 9B and may be any polygonal shape.

Figure 9C:
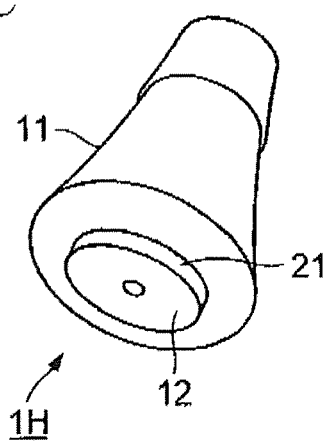

A silencer 1H illustrated in FIG. 9C is configured such that the entire portion of the outer wall of the bottom portion 12 near the body 11 is recessed in the direction directed from the large-diameter end 11*a* to the small-diameter end 11*b*, whereby the diameter of a circle formed by the outer wall of the body 11 when the body 11 is cut along the plane perpendicular to the axis of the body 11 is decreased, at a boundary between the portion of the outer wall near the bottom portion 12 and the portion of the outer wall not near the bottom portion 12, in the direction directed from the small-diameter end 11*b* toward the large-diameter end 11*a*. This silencer 1H does not have at least one of at least one protruding portion and at least one recessed portion around the axis of the body 11, on the portion of the outer wall of the body 11 near the bottom portion 12 but have at least one of at least one protruding portion and at least one recessed portion (i.e., inequalities) along the axial direction of the body 11, on the outer wall of the body 11 at a boundary between the portion of the outer wall near the bottom portion 12 and the portion of the outer wall not near the bottom portion 12. In this silencer 1H, when the silencer 1H is fitted in the wind instrument, a space defined between the inner wall of the bell 3 and the portion of the outer wall of the body 11 near the bottom portion 12 is larger than a space defined between the inner wall of the bell 3 and the portion of the outer wall of the body 11 not near the bottom portion 12. That is, an entire face extending in the axial direction of the body 11 from the circumference of the circle formed by the portion of the outer wall of the body 11 near the bottom portion 12 serves as the recessed portion 21. This construction allows the user to place his or her fingers and thumb from a front side of the bottom portion 12 onto the face extending in the axial direction of the body 11 from the circumference of the circle formed by the portion of the outer wall of the body 11 near the bottom portion 12. Accordingly, the user can easily remove the silencer 1H from the wind instrument. It is noted that the shape of the portion of the outer wall of the body 11 near the bottom portion 12 is not limited to the circle and may be an ellipse, for example.

Figure 9D:
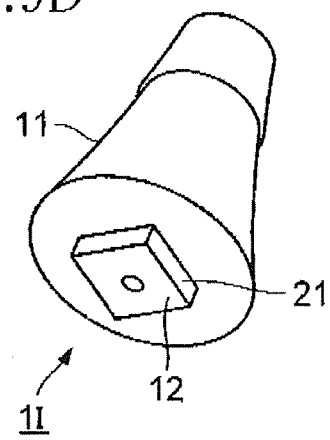

The silencer 1I illustrated in FIG. 9D is configured such that the shape of the outer wall of the body 11 when the body 11 is cut along the plane perpendicular to the axis of the body 11 is changed from a circle to a quadrangle, at a boundary between the portion of the outer wall near the bottom portion 12 and the portion of the outer wall not near the bottom portion 12, in the direction directed from the small-diameter end 11*b* toward the large-diameter end 11*a*. Also, the silencer 1I is configured such that the length of a diagonal line of the quadrangle formed by the portion of the outer wall of the body 11 near the bottom portion 12 is shorter than the diameter of the circle formed by a portion of the outer wall of the body 11 not near the bottom portion 12 at a boundary between the portion of the outer wall near the bottom portion 12 and the portion of the outer well not near the bottom portion 12. In the silencer 1I, as in the silencer 1G, planar faces extending in the axial direction of the body 11 from the respective sides of the quadrangle formed by the portion of the outer wall of the body 11 near the bottom portion 12 serve as the recessed portions 21. Accordingly, the silencer 1I can achieve the same effects as achieved by the silencer 1G. It is noted that the shape of the portion of the outer wall of the body 11 near the bottom portion 12 is not limited to the quadrangle.

Figure 10:
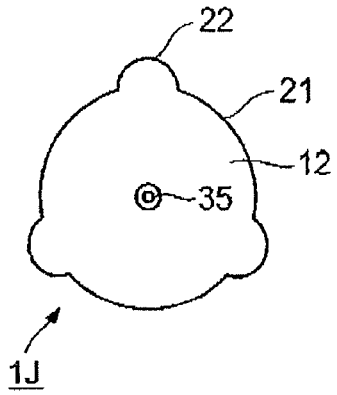
FIG. 10 is a front elevational view illustrating a construction of a silencer 1J as an alternative embodiment (8)
Figure 11:
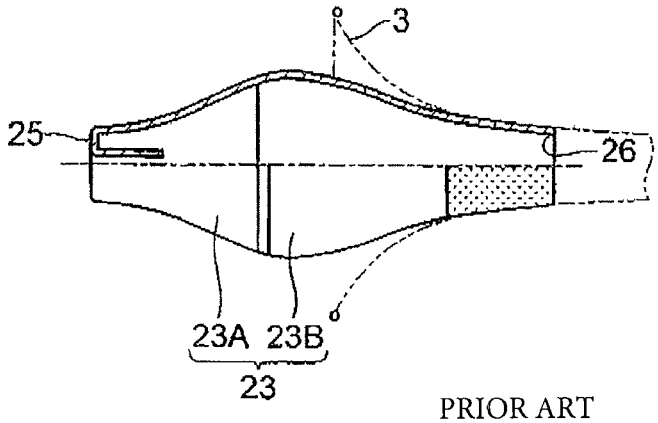
FIG. 11 is a side view illustrating a construction of a silencer disclosed in Patent Document 1.
Figure 12:
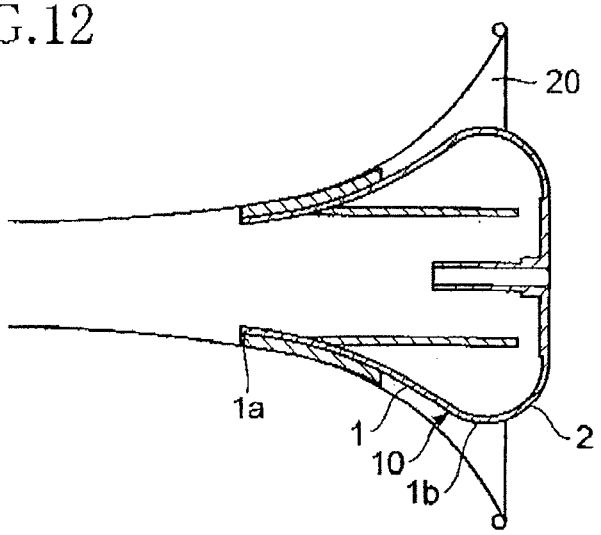
PRIOR ART FIG.12
FIG. 12 is an elevational view in vertical cross section illustrating a silencer disclosed in Patent Document 2.

(8) In the silencers 1, 1A, 1B, 1C, 1D, 1E according to the above-described embodiments, the recessed portions 21 and the protruding portions 22 are alternately provided around the axis of the body 11 so as to be spaced uniformly. However, both of the recessed portions 21 and the protruding portions 22 may not be provided. For example, a portion serving as the recessed portion 21 may be provided relative to the protruding portions 22. This alternative embodiment provides at least one of at least one protruding portion and at least one recessed portion (i.e., an inequality) in the portion of the outer wall of the body 11 near the bottom portion 12. FIG. 10 illustrates a silencer 1J according to an alternative embodiment. The silencer 1J is configured such that three protruding portions 22 are provided around the axis of the body 11 on the portion of the outer wall of the body 11 near the bottom portion 12 so as to be spaced uniformly. A portion of the outer wall between base portions of two of the protruding portions 22 which are adjacent to each other around the axis of the body 11 has a circular arc shape centered about the axis of the body 11. In this silencer 1J, when the silencer 1J is fitted in the wind instrument, a space defined between the inner wall of the bell 3 and the base portions of the protruding portions 22 on the outer wall of the body 11 is larger than a space defined between the inner wall of the bell 3 and the top portions of the protruding portions 22 on the outer wall of the body 11. That is, the base portions of the protruding portions 22 (more accurately, the portions each located between the base portions of the corresponding adjacent two protruding portions 22) relatively serve as the recessed portions 21. This construction allows the user to place his or her fingers and thumb onto the base portion of the protruding portions 22. When rotating the grabbed silencer 1J about the axis by a small amount, the fingers and thumb are caught by the protruding portions 22, allowing the user to easily rotate the silencer 1 about the axis of the body 11. This allows the user to easily remove the silencer 1J from the wind instrument. It is noted that the number, arrangement, and shape of the protruding portions 22 arranged around the axis of the body 11 are not limited to those illustrated in FIG. 10.

(9) The technique of providing at least one of at least one protruding portion and at least one recessed portion (i.e., an inequality) on the portion of the outer wall of the body 11 near the bottom portion 12 and the conventional technique of easily removing the silencer from the wind instrument may be combined with each other. For example, the silencer may be configured such that the recessed portions 21 are formed in the portion of the outer wall of the body 11 near the bottom portion 12, and the ring into which a finger can be inserted is provided on the outer wall of the bottom portion 12. The user can easily remove the silencer from the wind instrument by, for example, inserting and catching an index finger in and on the ring provided on the outer wall of the bottom portion 12 and placing the other fingers and thumb on the recessed portions 21 formed in the outer wall of the body 11

(10) The silencer may be configured such that at least one of at least one protruding portion and at least one recessed portion (i.e., an inequality) is provided on the portion of the outer wall of the body 11 near the bottom portion 12 and such that the outer wall of the bottom portion 12 has one or more depressions into which some or all of the fingers and thumb can be inserted. The user can easily remove the silencer from the wind instrument by, for example, inserting the thumb, the middle finger, and the ring finger into the depressions formed in the outer wall of the bottom portion 12 to grab wall faces of the depressions and placing the index finger and the little finger on the recessed portions 21 formed in the outer wall of the body 11.

(11) The silencer may be configured such that at least one of at least one protruding portion and at least one recessed portion (i.e., an inequality) is provided on the portion of the outer wall of the body 11 near the bottom portion 12 and such that depressions each deeper than the recessed portion 21 in the direction toward the axis of the body 11 are formed, at the positions of the recessed portions 21, in a portion of the outer wall of the body 11 near a boundary between the portion of the outer wall near the bottom portion 12 and the portion of the outer wall not near the bottom portion 12. In FIG. 1, the depressions are formed in portions of the body 11 which are nearer to the small-diameter end 11*b* than the portions of the body 11 in which the recessed portions 21 are formed (i.e., the portions extending parallel to the axis of the body 11). In this embodiment, the user places some of his or her fingers and thumb onto the recessed portions 21 and inserts the other fingers into the depressions formed in the portion of the outer wall of the body 11 near the boundary between the portion of the outer wall near the bottom portion 12 and the portion of the outer wall not near the bottom portion 12, whereby the user can grab the silencer at both of the recessed portions 21 and the depressions to easily remove the silencer from the wind instrument.

(12) The silencer may not have at least one of at least one protruding portion and at least one recessed portion (i.e., an inequality) on the closed end as long as at least one of at least one protruding portion and at least one recessed portion (i.e., an inequality) is provided on the portion of the outer wall of the body 11 near the closed end (i.e., near the bottom portion 12). That is, at least one of at least one protruding portion and at least one recessed portion (i.e., the recessed portions 21 and the protruding portions 22) may be provided on a position which is located within an area near the closed end and at which the closed end is not provided. For example, the recessed portions 21 not continuous to the closed end are formed in the outer wall of the body 11 at positions on the area near the closed end which are near the boundary between the area near the closed end and the area not near the closed end (i.e., at positions far from the closed end). In this construction, when the fingers are inserted into a space defined between the inner wall of the bell 3 and the outer wall of the body 11, the fingers can be placed on the recessed portions 21 located at positions far from the closed end within the area near the closed end, making it easy for the user to remove the silencer from the wind instrument. The silencer may also be configured such that the recessed portions 21 and the protruding portions 22 are provided at positions which are near the closed end and on which the closed end is provided, and such that the recessed portions 21 and the protruding portions 22 are provided at positions which are near the closed end and on which the closed end is not provided. For example, the recessed portions 21 continuous to the closed end are formed in the outer wall of the body 11 at positions near the closed end within the area near the closed end, and the recessed portions 21 not continuous to the closed end are formed in the outer wall of the body 11, within the area near the closed end, at positions near the boundary between the area near the closed end and the area not near the closed end. This construction achieves the same effects as achieved in the above-described constructions. It is noted that while there has been explained the embodiment in which the recessed portions 21 are formed in the positions far from the closed end within the area near the closed end, the protruding portions 22 may be provided at the positions instead of the recessed portions 21, and alternatively both of the recessed portions 21 and the protruding portions 22 may be provided at the positions.

(13) The silencer may be configured such that the coefficient of friction of the recessed portions 21 and the protruding portions 22 provided on the portion of the outer wall of the body 11 near the bottom portion 12 is larger than the coefficient of friction of the portion of the outer wall of the body 11 not near the bottom portion 12, i.e., the portion of the outer wall which is nearer to the small-diameter end 11*b* than the portion of the outer wall of the body 11 near the bottom portion 12. Examples of the method of increasing the coefficient of friction include: providing a non-slip sheet formed of, e.g., rubber on the recessed portions and the protruding portions; applying a non-slip coating on the recessed portions and the protruding portions; and providing fine grooves or fine depressions and projections arranged around and extending along the axis of the body 11, on the recessed portions and the protruding portions. This construction allows the fingers of the user to be reliably caught on the recessed portions and the protruding portions, allowing the silencer to be more easily removed from the wind instrument.

(14) The outer wall may be formed of a flexible material (such as urethane) which forms a recessed portion by deformation of the outer wall when a portion of the outer wall near the portion of the bottom portion 12 which is bonded to the body 11 is grabbed with, e.g., a finger and a thumb. That is, the recessed portion is formed by a force applied to the portion of the outer wall near the portion of the bottom portion 12 which is bonded to the body 11, and the recessed portion is not formed when no force is applied to the outer wall. Also, the outer wall may be formed of a hard material and a flexible material in combination such that when the outer wall is grabbed with, e.g., a finger and a thumb, only the portion formed of the flexible material is deformed so as to form recessed portions. For example, a flexible material may be disposed on an outer side of a hard material, and flexible materials and hard materials may be alternately arranged around the axis of the body 11.

What is claimed is:

1. A silencer for a wind instrument, comprising a hollow pipe whose one end in a direction along an axis of the pipe is a large-diameter end and serves as a closed end, the pipe comprising an outer wall on which a plurality of recessed portions or at least one protruding portion are formed in a vicinity of the closed end, the outer wall comprising a conical side wall which defines a side end of an inner space of the pipe, and a bottom wall which closes one end of the side wall such that the bottom wall defines a bottom end of the inner space of the pipe, wherein the plurality of recessed portions are formed on the outer wall and arranged around the axis of the pipe, wherein each of the plurality of recessed portions extends continuously from an outer surface of the bottom wall to an outer surface of the side wall, and wherein the plurality of recessed portions are formed on an outer edge of the bottom wall by a connection of the large-diameter end of the pipe to the outer surface of the bottom wall while keeping a shape of the plurality of recessed portions formed on the outer wall of the pipe.

2. The silencer according to claim 1, wherein the portion of the outer wall of the pipe in the vicinity of the closed end comprises the plurality of recessed portions.

3. The silencer according to claim 1, wherein the plurality of recessed portions and a plurality of protruding portions, as the at least one protruding portion are formed on the outer wall, and each of the plurality of protruding portions are disposed between corresponding two of the plurality of recessed portions which are adjacent to each other, wherein each of the plurality of recessed portions is bent in a direction toward the axis of the pipe, and wherein each of the plurality of protruding portions is bent in a direction away from the axis of the pipe.

4. The silencer according to claim 1, wherein a distance between each of the plurality of recessed portions and the axis of the pipe is constant in an area in which the plurality of recessed portions are formed in a direction in which the axis of the pipe extends.

5. The silencer according to claim 1, wherein the number of the plurality of recessed portions is an odd number.

6. The silencer according to claim 1, wherein the plurality of recessed portions comprise two recessed portions arranged such that an angle of (i) a line connecting one of the two recessed portions and the axis of the pipe and (ii) a line connecting another of the two recessed portions and the axis of the pipe is 180 degrees.

7. The silencer according to claim 1, wherein at least one of the plurality of recessed portions and the at least one protruding portion is repeatedly provided around the axis of the pipe so as to be spaced apart from each other uniformly.

8. The silencer according to claim 2, wherein another end of the pipe is an open end, and wherein at least one depression deeper than the plurality of recessed portions in a direction toward the axis of the pipe is formed in a portion of the outer wall which is nearer to said another end than the portion of the outer wall in which the plurality of recessed portions are formed.

9. The silencer according to claim 2, wherein the plurality of recessed portions comprises a friction increaser configured to increase a coefficient of friction of the recessed portions such that the coefficient of friction is greater than that of a portion of the outer wall in which the plurality of recessed portion are not formed.

10. The silencer according to claim 2, wherein when a force is applied to the portion of the outer wall in the vicinity of the closed end, the plurality of recessed portions are formed by deformation of the outer wall from a shape thereof taken when no force is applied to the portion of the outer wall in the vicinity of the closed end.

11. A silencer for a wind instrument, comprising a hollow pipe whose one end in a direction along an axis of the pipe is closed and serves as a closed end, the pipe comprising an outer wall on which a plurality of inequalities are formed on a portion thereof in a vicinity of the closed end, the outer wall comprising a conical side which defines a side end of an inner space of the pipe, and a bottom wall which closes one end of the side wall such that the bottom wall defines a bottom end of the inner space of the pipe, wherein the plurality of inequalities are formed on the outer wall and arranged around the axis of the pipe, and wherein each of the plurality of inequalities extends continuously from an outer surface of the bottom wall to an outer surface of the side wall, and wherein the plurality of inequalities are formed on an outer edge of the bottom wall by a connection of a large-diameter end of the pipe to the outer surface of the bottom wall while keeping a shape of the plurality of inequalities formed on the outer wall of the pipe.

12. The silencer according to claim 1, wherein a first end of each of the plurality of recessed portions is positioned on the large-diameter end of the pipe and a second end of each of the plurality of recessed portions are positioned such that a position of the second end of each of the plurality of recessed portions is nearer to the bottom wall than a mount portion which contacts with an inner wall of a bell of the wind instrument.

13. The silencer according to claim 1, wherein the plurality of recessed portions or the at least one protruding portion are repeatedly provided in a smooth wavy shape around the axis of the pipe.

14. The silencer according to claim 11, wherein a first end of each of the plurality of inequalities is positioned on the large-diameter end of the pipe and a second end of each of the plurality of inequalities are positioned such that a position of the second end of each of the plurality of inequalities is nearer to the bottom wall than a mount portion which contacts with an inner wall of a bell of the wind instrument.

* * * * *